US007743710B2

(12) United States Patent
Gordon

(10) Patent No.: US 7,743,710 B2
(45) Date of Patent: Jun. 29, 2010

(54) ROLLER COASTER MAINTENANCE VEHICLE

(76) Inventor: Jonathan I. Gordon, 1200 N. Herndon St., Apt. 301, Alexandria, VA (US) 22201

( * ) Notice: Subject to any disclaimer, the term of this patent is extended or adjusted under 35 U.S.C. 154(b) by 101 days.

(21) Appl. No.: 11/870,481

(22) Filed: Oct. 11, 2007

(65) Prior Publication Data

US 2009/0095190 A1 Apr. 16, 2009

(51) Int. Cl.
*A63G 1/00* (2006.01)

(52) U.S. Cl. ..... 104/53; 104/307; 104/2

(58) Field of Classification Search ..... 104/52, 104/138.1–138.2; 246/166
See application file for complete search history.

(56) References Cited

U.S. PATENT DOCUMENTS

| | | | | |
|---|---|---|---|---|
| 699,960 | A | 5/1902 | Lachase | |
| 850,136 | A | 4/1907 | Cole | |
| 1,621,337 | A | 3/1927 | Schmeck | |
| 1,741,286 | A | 12/1929 | Church | |
| 1,881,151 | A | 10/1932 | Traver | |
| 4,170,943 | A | 10/1979 | Achrekar | |
| 5,272,984 | A | 12/1993 | Bolliger et al. | |
| 5,595,121 | A * | 1/1997 | Elliott et al. | 104/53 |
| 5,623,244 | A * | 4/1997 | Cooper | 340/425.5 |
| 5,878,837 | A * | 3/1999 | Kistner | 182/129 |
| 6,550,393 | B2 | 4/2003 | Stengel | |
| 6,832,873 | B1 * | 12/2004 | Kadrnoska et al. | 405/183.5 |
| 7,131,382 | B2 | 11/2006 | Gordon | |
| 2007/0031217 | A1 * | 2/2007 | Sharma | 414/222.08 |
| 2009/0025598 | A1 * | 1/2009 | Menser et al. | 104/93 |

OTHER PUBLICATIONS

Great Coasters International Inc. (ww.greatcoasters.com) Jul. 31, 2003.
Translation of www.coaster.at, ©2006.
Mechanic's Padded Steel Creeper, Garage Pro Mechanic's Padded Steel Creeper, JC Whitney: Auto Parts and Accessories, available at www.jcwhitney.com, downloaded Jan. 26, 2007.

* cited by examiner

*Primary Examiner*—S. Joseph Morano
*Assistant Examiner*—Zachary Kuhfuss
(74) *Attorney, Agent, or Firm*—Gordon & Jacobson, PC

(57) ABSTRACT

A roller coaster maintenance vehicle includes a platform with a set of wheels arranged to ride on a roller coaster track structure. The platform includes a propulsion system which allows it to traverse the track structure independent of the roller coaster propulsion system. In one embodiment, a person rides on the vehicle and controls its movement. In another embodiment the vehicle is remotely controlled. Remotely controlled vehicles preferably include one or more inspection apparatus for inspecting the track structure. Optionally, the remotely controlled vehicles also include remotely controlled repair/maintenance equipment such as a robotic arm with a power tool coupled to its free end.

19 Claims, 12 Drawing Sheets

ROLLER COASTER MAINTENANCE VEHICLE

INCORPORATION BY REFERENCE

Reference to my earlier U.S. Pat. No. 7,131,382, the complete disclosure of which is hereby incorporated herein by reference, will assist in understanding the present invention.

BACKGROUND OF THE INVENTION

1. Field of the Invention

This invention relates broadly to roller coaster maintenance. More particularly, this invention relates to vehicles employed for roller coaster maintenance.

2. State of the Art

Roller coasters have enjoyed immense popularity in the United States and elsewhere for over one hundred years. These rides often consist of a passenger carrying vehicle, or collection of vehicles joined together, which traverse along a track system. Historically, the track system typically comprised a pair of parallel rails which exhibit steep upward and downward gradients in elevation, and sharp left and right turns. Roller coaster cars are mounted on the track system and are propelled along the track system by a roller coaster propulsion system. The roller coaster propulsion system is arranged to tow roller coaster cars up steep track sections and then release them so that gravity operates to propel the cars down steep track sections, hence the term "coaster". Aside from supplying the passengers with a pleasing panoramic view from high elevations, the main objective of the roller coaster ride is to thrill the passengers by traversing the track at the fastest possible speed while maintaining an acceptable degree of safety. The thrill experienced by the passengers arises from the sensations of rapid acceleration, brought about through rapid changes in vertical and horizontal direction of movement. It can be said that the thrills are generally only experienced when the cars are ballistic. However, some modern coasters accelerate the cars under power prior to letting them go ballistic and the powered acceleration can also be thrilling.

Innovations in roller coaster design have sought to enhance and intensify passenger thrill by substantially increasing the speed of movement along the track system, and hence, the resulting forces of acceleration experienced by the passenger. These innovations were greatly facilitated by technological advances in materials engineering, a direct result of which enabled the construction of stronger and lighter track systems and passenger vehicles. However, attendant with ever increasing speeds of the passenger vehicles is the ever increasing risk of catastrophic failure of the ride.

My previously incorporated earlier patent discloses an amusement ride having a wood supported running track that is realized by two wooden track structures and a support beam that is disposed above the two wooden track structures and bridges the two wooden track structures. Metal strips are laid atop the wooden track structures. A passenger carrier (e.g., coaster car) has a frame structure with a first set of wheels mounted thereto that are adapted to run along the metal strips of the first and second wooden track structures during positive-g motion of the passenger carrier. At least one seat is suspended from the frame structure below the first set of wheels. This suspended wooden rail coaster design provides a distinctive rough, noisy, out of control feeling in addition to a distinctive feeling of freedom (and risk/danger), which are enjoyed by many roller coaster enthusiasts.

To guide the car during negative-g motion, a second pair of track structures arranged either above or below the two wooden track structures and the coaster car is provided with a second set of wheels which are arranged adjacent to the second pair of track structures. In addition, a third pair of track strictures and a third set of wheels are provided to guide the car against lateral-g motion.

Safety in roller coaster design and maintenance is of paramount importance. In the case of wooden coasters, maintenance personnel inspect the track on a daily basis and make repairs and maintenance as needed. Historically, the maintenance crew literally "walked the track" looking for loose bolts, weakened wood, etc. That procedure is still used today with modern wooden coasters. The suspended wood coaster and steel coasters cannot be inspected in that manner. Inspection and maintenance of steel coasters is typically performed with a cherry picker or the like.

SUMMARY OF THE INVENTION

The present invention provides methods and apparatus for inspecting and maintaining roller coasters. According to one aspect of the present invention roller coaster maintenance vehicles are provided which can be used to inspect and maintain all types of roller coasters. According to another aspect of the present invention a remotely operable roller coaster inspection and maintenance vehicle is provided.

More particularly, a first embodiment of the invention provides a self-propelled inspection/maintenance vehicle which rides along the roller coaster tracks under the control of an inspection/maintenance person riding in/on the vehicle. According to the first embodiment, the vehicle includes a horizontal platform having wheels which engage the track structures of my previously incorporated prior patent. The vehicle is designed to be operated by an inspection/maintenance person who is lying (prone or supine) on the horizontal platform. Since the platform will not maintain its horizontal orientation as the vehicle traverses the roller coaster track, a harness is provided to keep the inspection/maintenance person on the platform. The vehicle is also arranged such that the inspection/maintenance person's head is located between the track structures so that they can be inspected easily.

The vehicle of the first embodiment is self-propelled by a motor which drives a pinion (spur gear) and the roller coaster track is modified to include a "third rail" in the form of a toothed rack (cog) which is engaged by the pinion (spur gear). According to preferred embodiments, the vehicle is provided with a tool bin which extends downward from the horizontal platform. The tool bin is advantageously "self-righting" via an articulate coupling to the platform.

According to a second embodiment, an inspection/maintenance vehicle is provided with a platform having wheels designed to engage a conventional wooden roller coaster track. The platform is also provided with an inclined support for an inspection/maintenance person. The inclined support is designed to provide the inspection/maintenance person with a good view of the track structure. In the second embodiment, when repairs need to be made, the inspection/maintenance person can leave the vehicle and walk the sides of the track in a conventional manner. The second embodiment may be provided with the same propulsion system as the first embodiment. It is preferably provided with a safety restraint (e.g. handlebar or harness) for the inspection/maintenance person and a tool bin.

A third embodiment of the invention is similar to the second embodiment but is designed for use on a steel roller coaster track. An alternate third embodiment uses a somewhat different propulsion system referred to as "tires and fin". This system uses a vertical fin in place of the rack (cog) rail and a pair of horizontally mounted tires in place of the pinion (spur gear). The tires frictionally engage both sides of the fin so that when the tires are rotated, the vehicle is pushed along the track. The "tires and fin" propulsion system may be used in any of the embodiments.

The first three embodiments have commonality in that they are all self-propelled and independent of the coaster propulsion system. They are all under the control of the inspection/maintenance person who is riding on/in the vehicle and they all provide an orientation which allows the inspection/maintenance person a good view the track. They all preferably also provide a tool bin which may also be used to contain repair supplies such as wood, grease, nails, bolts, etc., in addition to tools. As described below in the detailed description, different modes of propulsion may be provided, preferably with an on-board power source. However, it is possible to use an external power source such as an electrical third rail. The controls for the propulsion system preferably allow control over the direction of movement and speed of movement. A reliable braking mechanism is preferably also provided. Optionally, each of these three embodiments may also include an on board source of compressed air for use with pneumatically driven tools. Other tools can also be provided such as an ultrasound inspection device and/or a welding kit for steel repairs.

According to a fourth embodiment of the invention, a remotely controlled inspection vehicle (incapable of making repairs or maintenance) is provided with one or more sensors and a transceiver. The sensors preferably include one or more video cameras arranged such that a remote operator may view real time images of the track structure on a remote video display. The cameras are preferably mounted on a powered gimbal (or the like) so that they can pan and tilt and are preferably provided with remotely operable zoom lenses. Thermal imaging with a video camera and an infrared heat source (or other appropriate equipment) can be provided to examine steel track structures for flaws and wooden track structures for deterioration. Ultrasound and audible sound sensors can also be used.

A fifth embodiment of the invention adds remotely controllable repair/maintenance equipment to the fourth embodiment. The remotely controllable equipment is in the nature of an industrial robot arm. For example, an articulate arm with an electrically or pneumatically powered bolt tightener is useful to maintain most track structures in use today. In some cases, a robotic arm with a nail gun may be useful. Remotely operated grease guns and/or a remotely operated welding kit may also be provided.

A sixth embodiment of the invention includes a cherry picker like bucket so that the inspection/maintenance person can stand while riding the vehicle.

Additional objects and advantages of the invention will become apparent to those skilled in the art upon reference to the detailed description taken in conjunction with the provided figures.

BRIEF DESCRIPTION OF THE DRAWINGS

FIG. 2 is a schematic side elevation view of the vehicle of FIG. 1;

DETAILED DESCRIPTION

Figure 1:
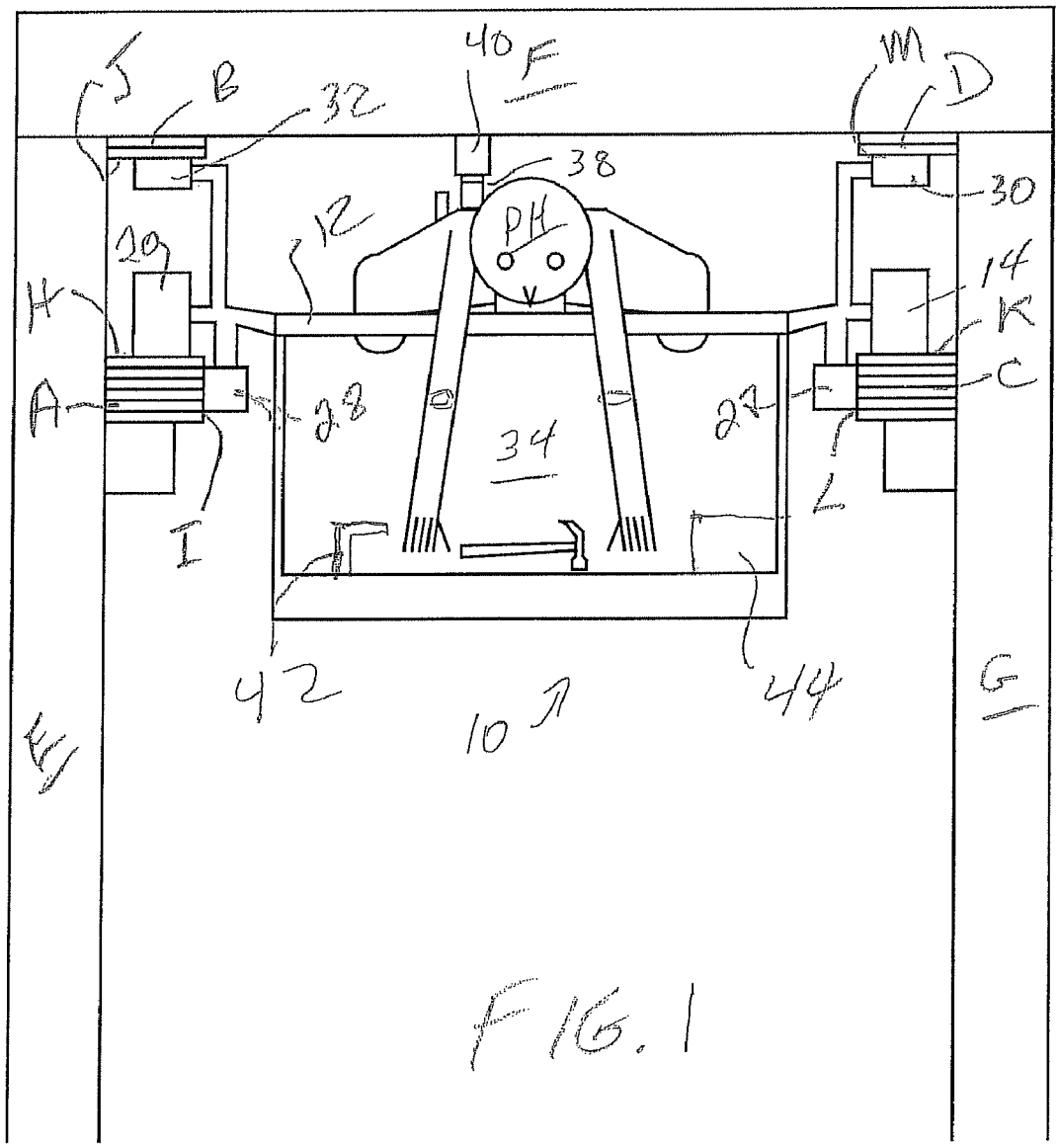
FIG. 1 is a schematic front elevation view of a first embodiment of a roller coaster maintenance vehicle according to the invention.

Turning now to FIGS. 1-5, a first embodiment of a roller coaster maintenance vehicle 10 is shown in conjunction with track structures similar to those disclosed in previously incorporated U.S. Pat. No. 7,131,382. Four track structures A, B, C, D are shown. The track structures are supported by timbers E, F, G, which are periodically located along the length of the track structures as illustrated, e.g., in FIG. 2 as F, F' and G, G'. The wooden track structures A and C are provided with metal strips or rails H, I and K, L, respectively. The wooden track structures B and D are provided with metal strips J and M respectively. All of the components A-M are assembled as described in my previously incorporated prior patent. From the foregoing it will be appreciated that six rails are provided upon which the vehicle 10 may ride: a pair of lower rails H and K, a pair of upper rails J and M, and a pair of side rails I and L.

Referring now to the maintenance vehicle 10, it includes a platform 12 having four lower wheels 14, 16, 18, 20 and four side wheels 22, 24, 26, 28. Two upper (up-stopping) wheels 30, 32 are preferably provided near the front of the vehicle for reasons which will be described immediately below. The lower wheels support the vehicle under positive-g force. The side wheels support the vehicle under lateral-g force and the upper wheels support the vehicle under negative-g force. According to the illustrated embodiment, the platform 12 is also provided with a tool bin 34 which depends downwardly from the platform. The tool bin may be provided with a cover or door (not shown) to keep the tools inside the bin when the vehicle is under negative-g force. Alternatively, the tool bin 34 may be coupled to the platform 12 by a hinge or gimbal so that the tools therein are always subject to a positive-g force. Although the vehicle will typically not experience g forces due to its movement, certain track inversions will cause negative or lateral g forces.

According to the invention, the maintenance vehicle 10 is self-propelled. As illustrated, the vehicle 10 is provided with a motor 36 (seen best in FIG. 3) which is mounted on the platform 12. The motor 36 is coupled to and drives a pinion or spur gear 38. As seen best in FIGS. 2, 4, and 5, the roller coaster track has been modified to include a cog rack 40. (The cog rack 40 may take the place of the inverted T-shaped rail 141 shown in previously incorporated U.S. Pat. No. 7,131,382.) The motor 36, gear 38 and cog rack 40 are all arranged at locations such that the spur or pinion gear 38 engages the cog rack 40. In the illustrated embodiment, the cog rack 40 is located above the pinion gear 38 and is mounted on the cross beam timbers F, F', etc. See, FIGS. 2, 4, and 5. Because of this arrangement of the rack and gear, there is no need for rear upper wheels as the gear and rack perform the up-stopping function sufficiently.

The motor 36 can be any type of powered motor, for example electric, gasoline, pneumatic, propane, etc. It is preferred that the power source 44 (FIGS. 1 and 3) be carried on board the vehicle. However, it is possible to construct a "third rail" type of power supply. A motor control 42 is preferably provided within easy reach of the person P riding on the vehicle 10. A presently preferred motor control 42 is a lever with a dead man's switch. Moving the lever forward causes the motor to move the vehicle forward. The more forward the lever is moved, the faster the vehicle will go. Moving the lever rearward causes the motor to move the vehicle rearward. The more rearward the lever is moved, the faster the vehicle will go. Centering the lever will stop the vehicle as will releasing the lever in whatever position it is in. The vehicle is stopped by a braking mechanism. The presently preferred embodiments utilize a Baldor motor such as those available from Reliance Electric Motors, Greenville, S.C. An alternative to using a separate braking mechanism is to place a load across the poles of an electric motor when the vehicle is to be stopped. When the vehicle is stopped on a horizontal portion of track, it may not be necessary to keep the brake applied once the vehicle has come to a stop. However, when the vehicle in another position, it will likely be necessary to keep applying the brake. Yaw, pitch, and roll sensors can be used to determine when the brake should continue to be applied or for simplicity the brake can be continuously applied whenever the control lever is centered or grip on the control lever is released, regardless of what position the vehicle is in.

If the motor 36 is a pneumatic motor, the power source 44 may be an air compressor and/or a compressed air bottle. In this case, the power source 44 may also be used to power popular pneumatically driven tools. Similarly, if the motor 36 is electric, the power source can be used to power popular electric power tools.

A manually powered drive mechanism such as pedals or a hand crank may be provided in lieu of a motor or may be provided as a back-up propulsion system in case of failure of the primary propulsion system.

Figure 4:
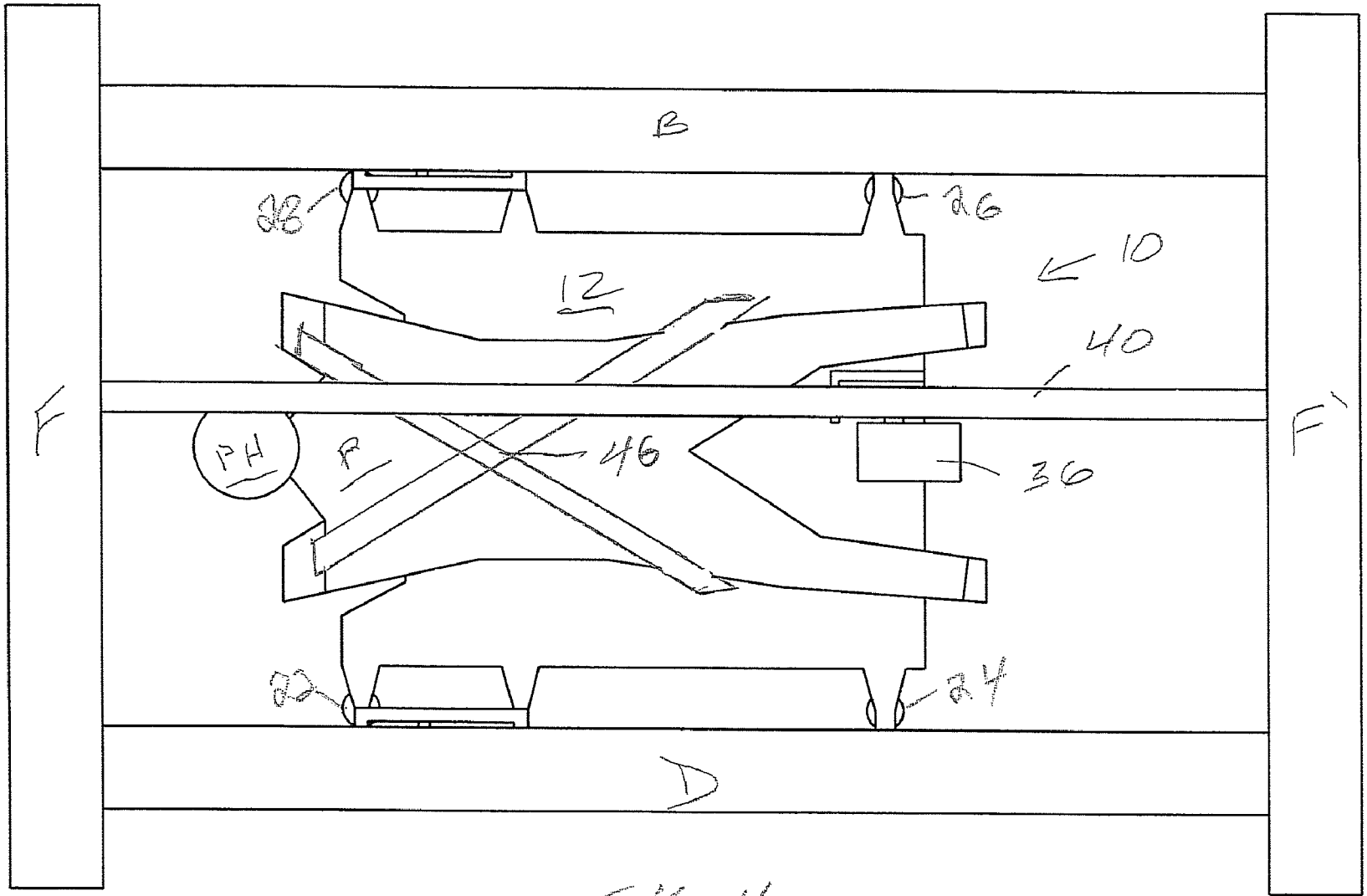
FIG. 4 is a schematic top plan view of the vehicle of FIG. 1.
Figure 5:
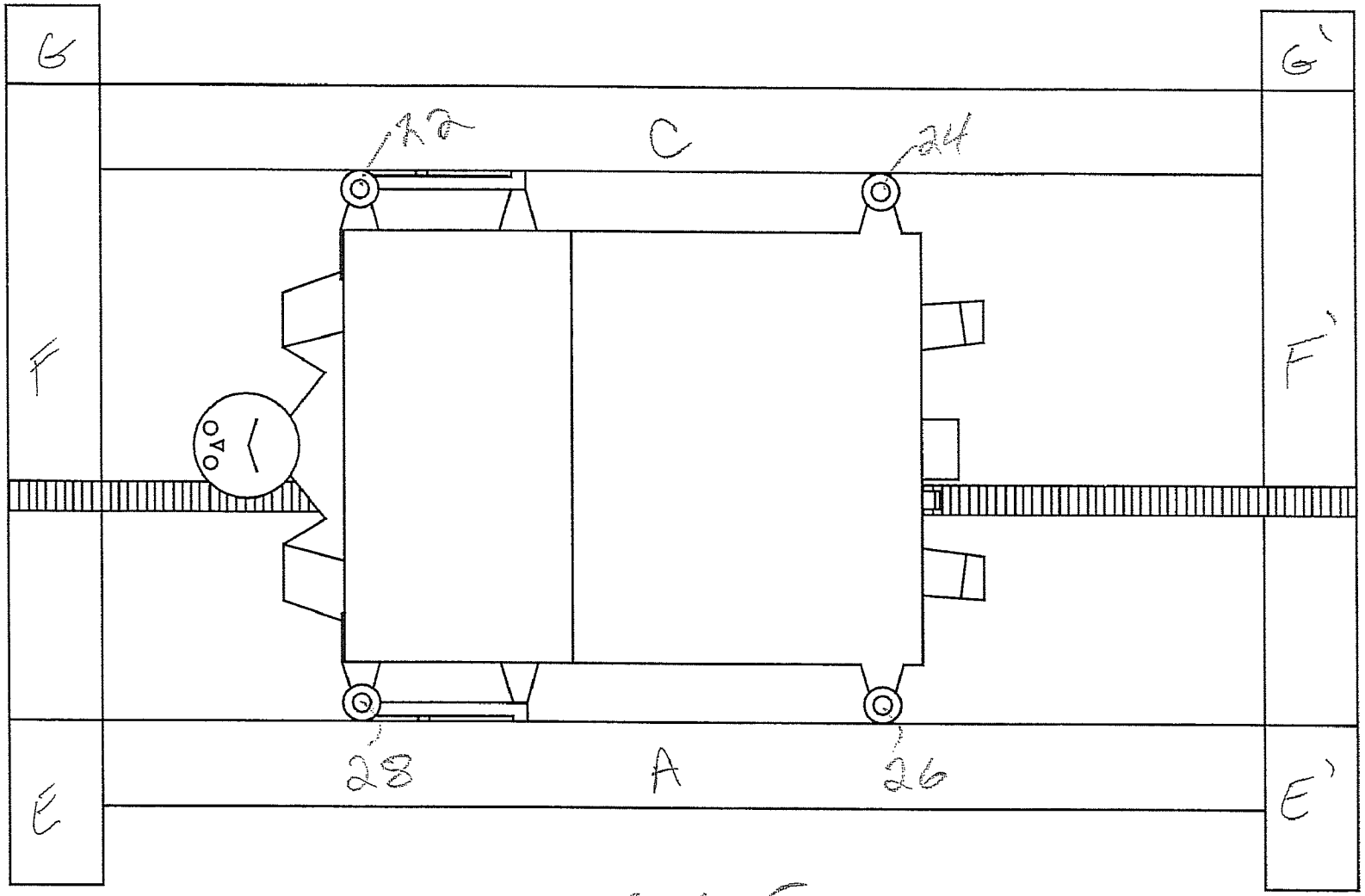
FIG. 5 is a schematic bottom plan view of the vehicle of FIG. 1.

As shown in FIG. 4, the vehicle 10 is preferably provided with a harness 46 to secure the maintenance/inspection person P who rides on the vehicle in either the prone or supine position. As seen best in FIG. 1, it will be appreciated that when in the prone position the person's head PH is in a very good position to inspect the track structures A and C and a good position to inspect track structures B and D. In the supine position, the person's head PH is in a very good position to inspect the track structures B and D and a good position to inspect track structures A and C. Depending on the gauge of the track system, the maintenance/inspection person may be able to effect repairs and maintenance without releasing the harness. In some instances, it may be necessary for the maintenance/inspection person to release the harness and slide left or right to get close enough to the track structures to make repairs or perform maintenance procedures. Alternatively, the platform 12 may be provided with a dolly-like (or creeper-like) structure (with brakes) which allows the maintenance/inspection person to slide sideways without releasing the harness.

Figure 7:
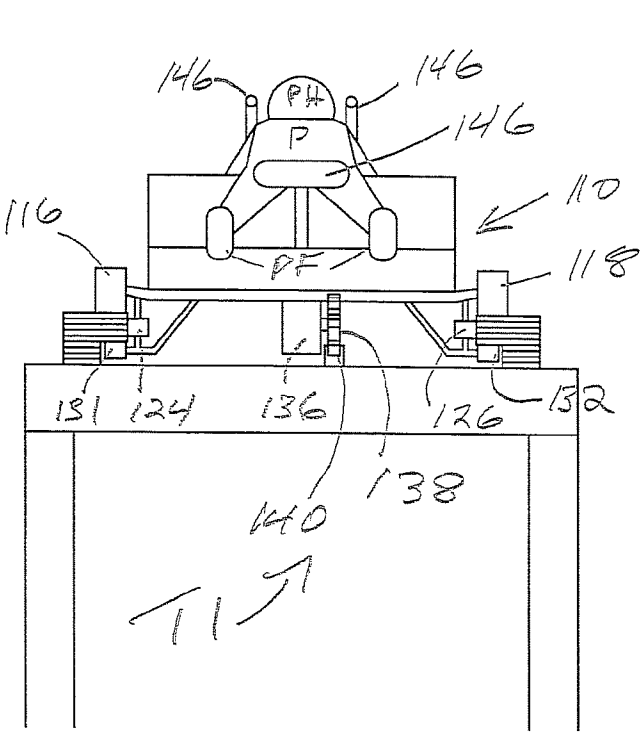
FIG. 7 is a schematic rear elevation view of the vehicle of FIG. 6.
Figure 6:
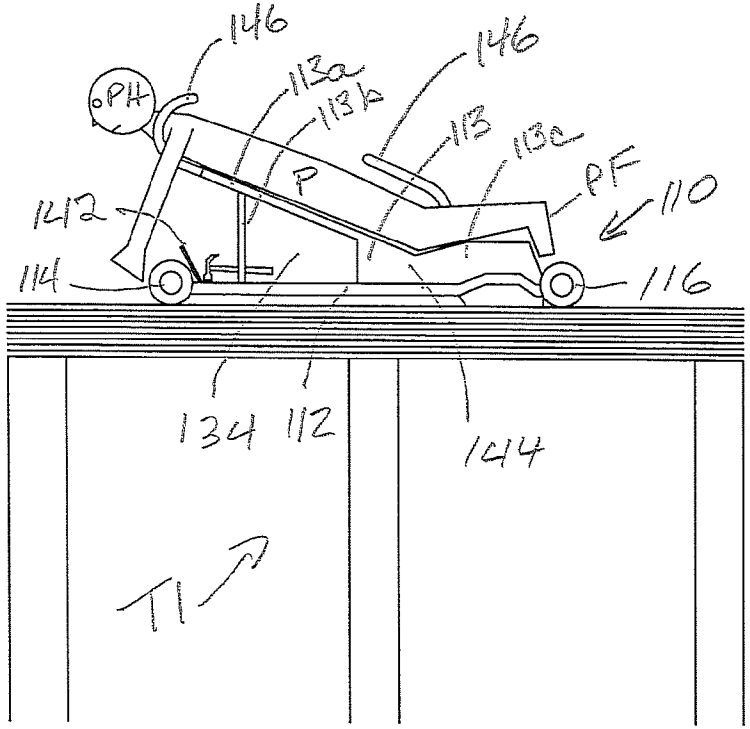
FIG. 6 is a schematic side elevation view of a second embodiment of a roller coaster maintenance vehicle according to the invention.

Turning now to FIGS. 6 and 7, a second embodiment of a roller coaster maintenance vehicle 110 is shown with similar reference numerals, increased by one hundred relative to the embodiment of FIGS. 1-5, referring to similar parts. The vehicle 110 is designed for use on a conventional wooden coaster ride with a wooden track system 1. The vehicle 110 has a platform 112 to which twelve wheels are coupled, three at each corner. Only seven of the twelve wheels can be seen in FIGS. 6 and 7. These are the positive g-force wheels 114, 116, 118, the lateral-g force wheels 124, 126, and the negative-g force wheels 131, 132. Those skilled in the art will appreciate that the front of the vehicle, which is not shown in the drawings, has the same wheel arrangement as the rear of the vehicle which is shown in FIG. 7.

Preferably, an inclined support 113 with a harness 146 is located on the platform, upon which an inspection/maintenance person P can lie in a prone position. As illustrated, the forward inclined portion 113*a* of the support is supported by one or more struts 113*b* which leave an open space 134 where tools and materials can be stored. As illustrated, the support 113 is also provided with a rearward inclined portion 113*c* which raises the person's feet PF up and away from the track structures. The inclined portions of the support 113 may be at any angle greater than zero degrees and less than ninety degrees, but twenty to forty degrees is the more useful range.

As in the first embodiment, the vehicle 110 is provided with an on-board propulsion system which includes a motor 136 coupled to a gear 138 which engages a rack 140 which is mounted on the track system T1. A controller 142, like the controller 42 in the first embodiment, is located at a place where it can easily be reached and operated by the person P. A power supply 144 is conveniently located beneath the rearward inclined portion 113*c* of the support 113.

Figure 8:
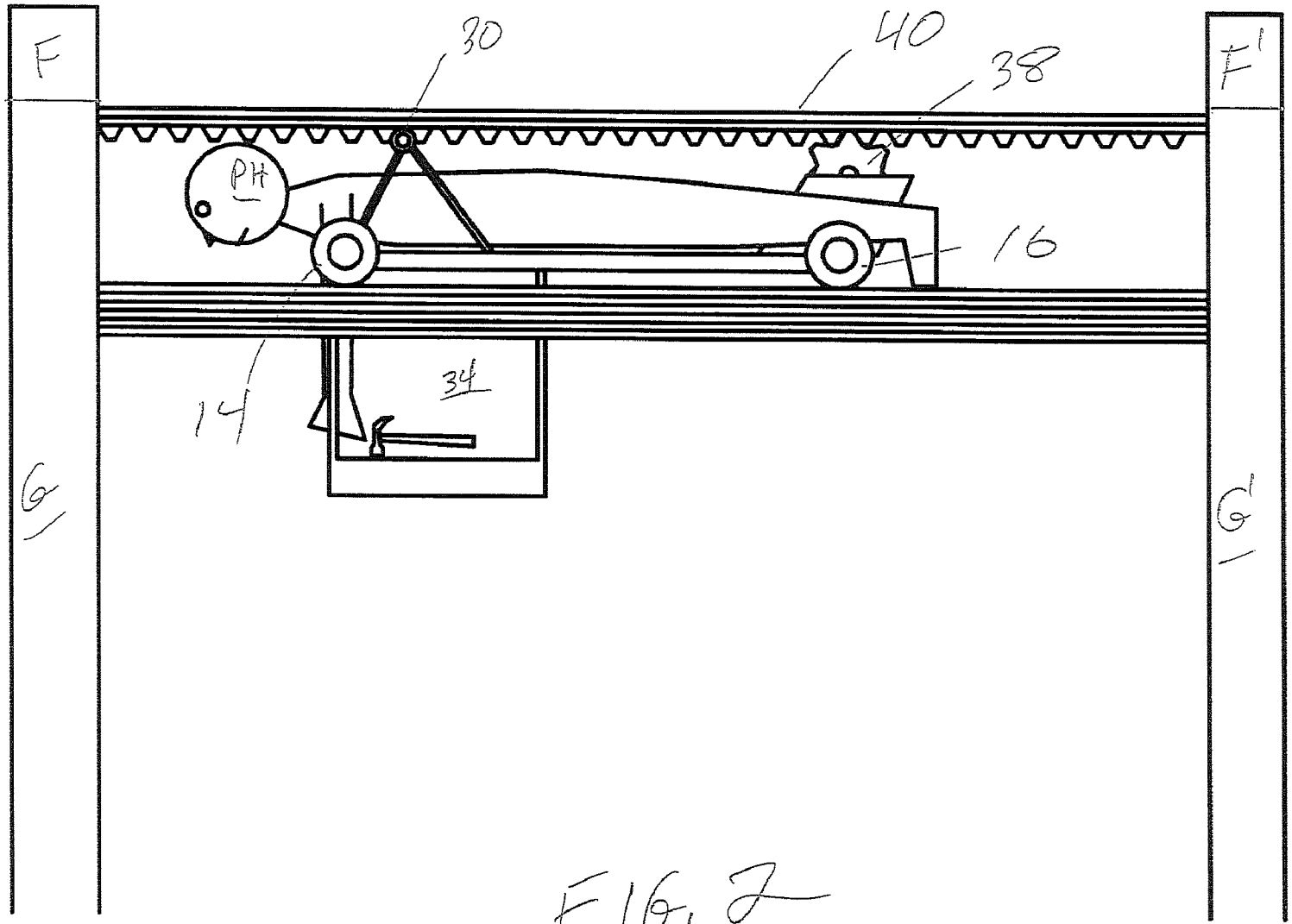
FIG. 8 is a schematic side elevation view of a third embodiment of a roller coaster maintenance vehicle according to the invention.
Figure 3:
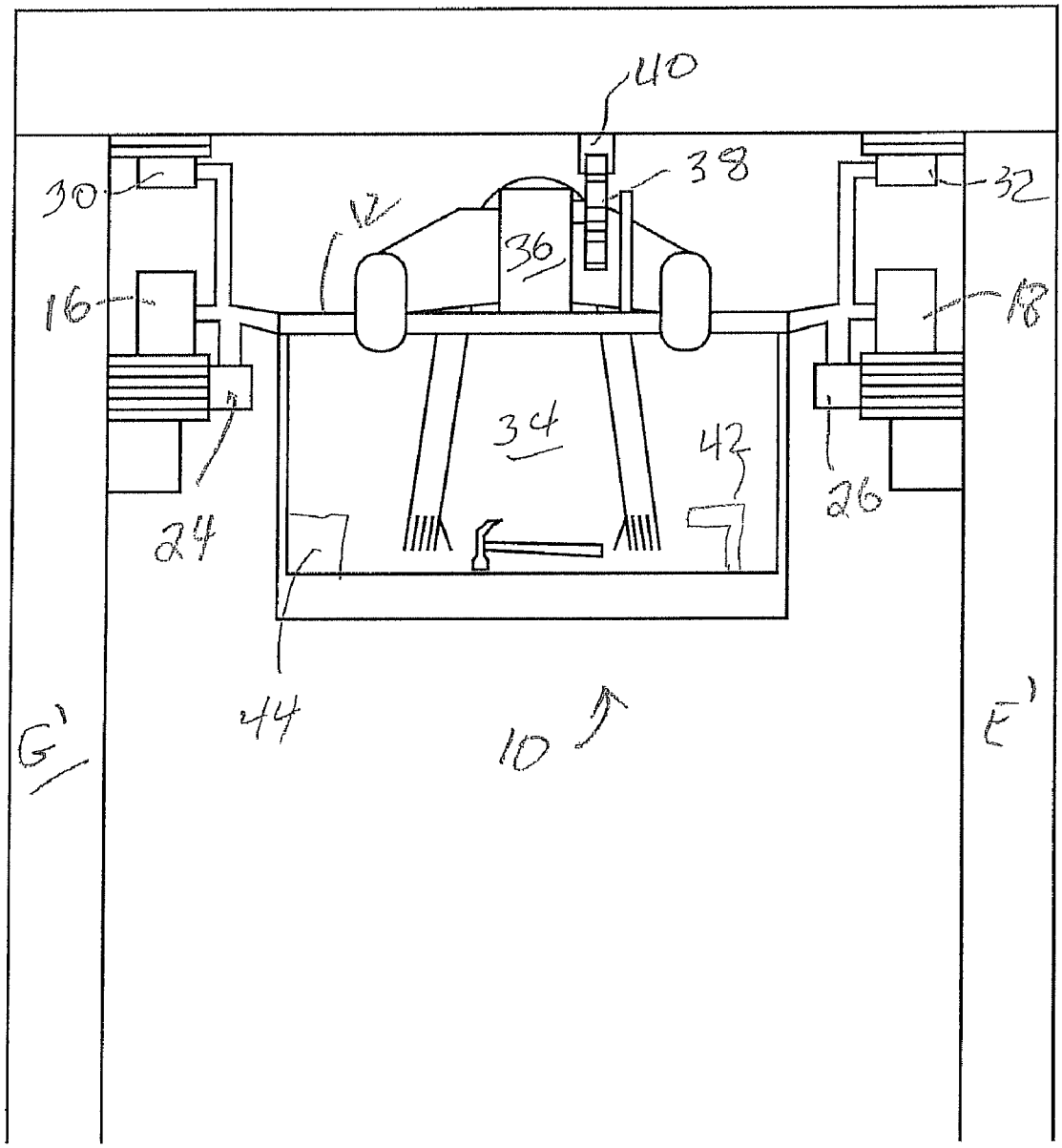
FIG. 3 is a schematic rear elevation view of the vehicle of FIG. 1.
Figure 9:
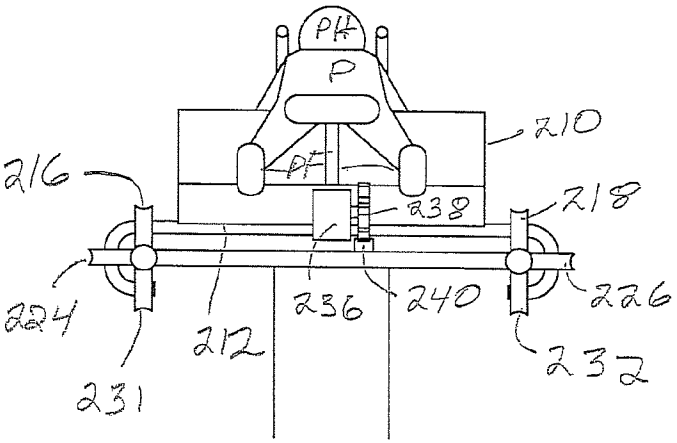
FIG. 9 is a schematic rear elevation view of the vehicle of FIG. 8.
Figure 8:
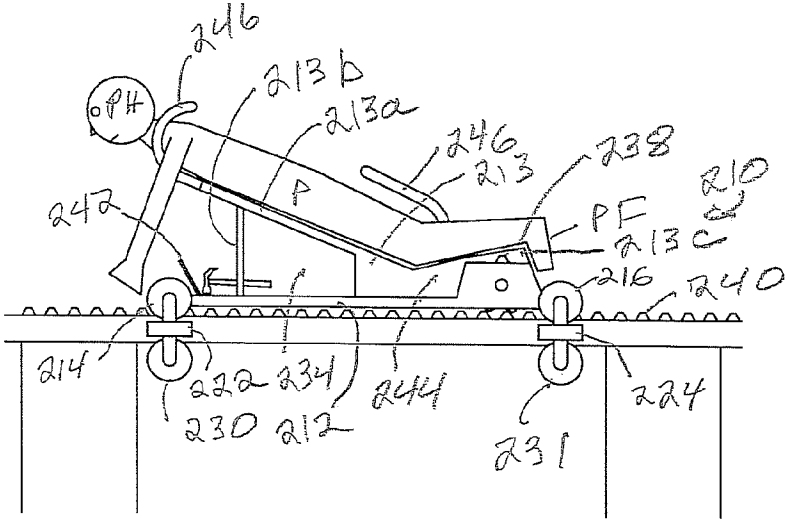

Turning now to FIGS. 8 and 9, a third embodiment of a roller coaster maintenance vehicle 210 is shown with similar reference numerals, increased by two hundred relative to the embodiment of FIGS. 1-5, referring to similar parts. The vehicle 210 is designed for use on a conventional steel coaster ride with a tubular steel track system T2. The vehicle 210 has a platform 212 to which twelve wheels are coupled, three at each corner. Only nine of the twelve wheels can be seen in FIGS. 8 and 9. These are the positive g-force wheels 214, 216, 218, the lateral-g force wheels 222, 224, 226, and the negative-g force wheels 230, 231, 232. Those skilled in the art will appreciate that front of the vehicle, which is not shown in the drawings has the same wheel arrangement as the rear of the vehicle which is shown in FIG. 9.

Preferably, an inclined support 213 with a harness 246 is located on the platform, upon which an inspection/maintenance person P can lie in a prone position. As illustrated, the forward inclined portion 213*a* of the support is supported by one or more struts 213*b* which leave an open space 234 where tools and materials can be stored. As illustrated, the support 213 is also provided with a rearward inclined portion 213*c* which raises the person's feet PF up and away from the track structures. The inclined portions of the support 213 may be at any angle greater than zero degrees and less than ninety degrees, but twenty to forty degrees is the more useful range.

As in the first and second embodiments, the vehicle 210 is provided with an on-board propulsion system which includes a motor 236 coupled to a gear 238 which engages a rack 240 which is mounted on the track system T2. A controller 242, like the controller 42 in the first embodiment and the controller 142 in the second embodiment, is located at a place where it can easily be reached and operated by the person P. A power supply 244 is conveniently located beneath the rearward inclined portion 213*c* of the support 213.

Comparing FIGS. 6 and 7 with FIGS. 8 and 9, it will be appreciated that the only significant difference between the second embodiment and the third embodiment is the arrangement of the twelve wheels, the former being arranged to ride on the track system of a wooden coaster ride and the latter being arranged to ride on the track system of a steel coaster ride.

Figure 9A:
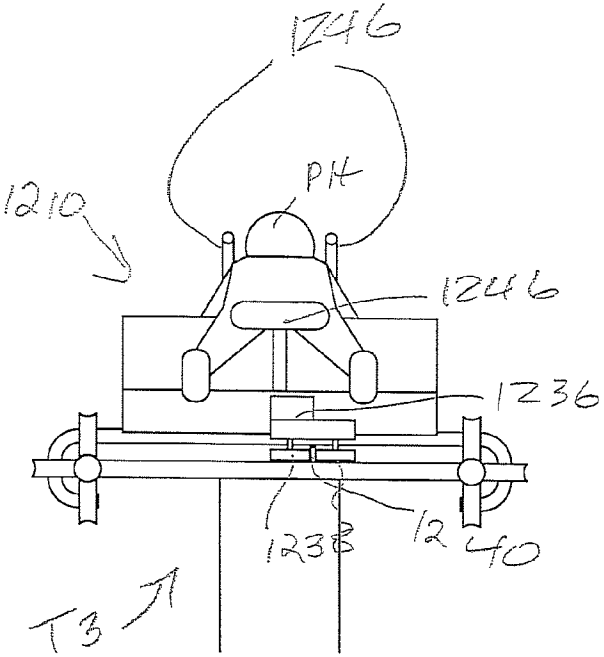
FIG. 9A is a view similar to FIG. 8 but illustrating the alternate propulsion system of FIG. 8A.
Figure 8A:
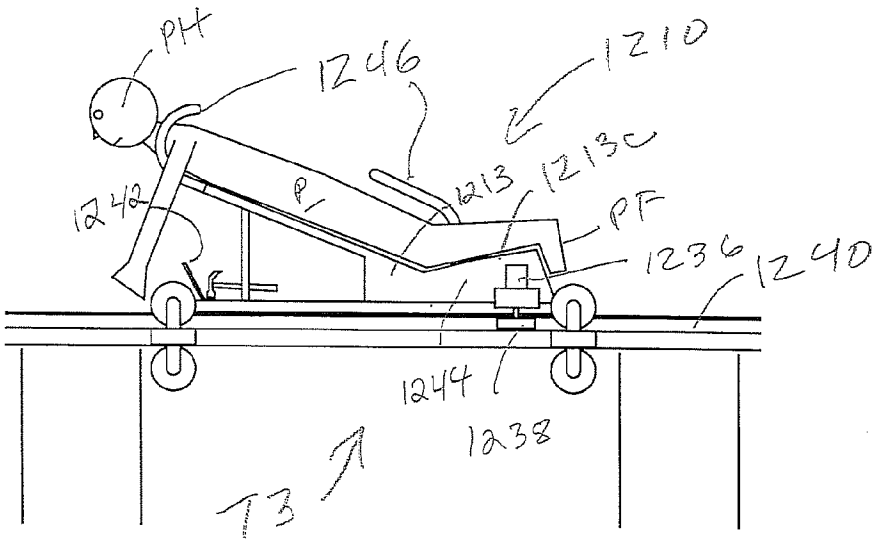
FIG. 8A is a view similar to FIG. 8 but illustrating an alternate propulsion system.

FIGS. 8A and 9A illustrate a vehicle 1210 which is similar to the vehicle 210 with similar reference numerals (increased by 1000) referring to similar parts. The only significant difference between the vehicle 1210 and the vehicle 210 is the propulsion system. In this embodiment, the propulsion system includes a motor 1236 coupled to one or two tires 1238 which engages a vertical fin 1240 which is mounted on the track system T3. A controller 1242 is located at a place where it can easily be reached and operated by the person P. A power supply 1244 is conveniently located beneath the rearward inclined portion 1213*c* of the support 1213. Two tires 1238 are preferred over a single tire but only one tire need be coupled to the motor 1236. The other tire can be an idler tire which is coupled to the powered tire and biased to press both tires onto opposite sides of the fin 1240.

Figure 10:
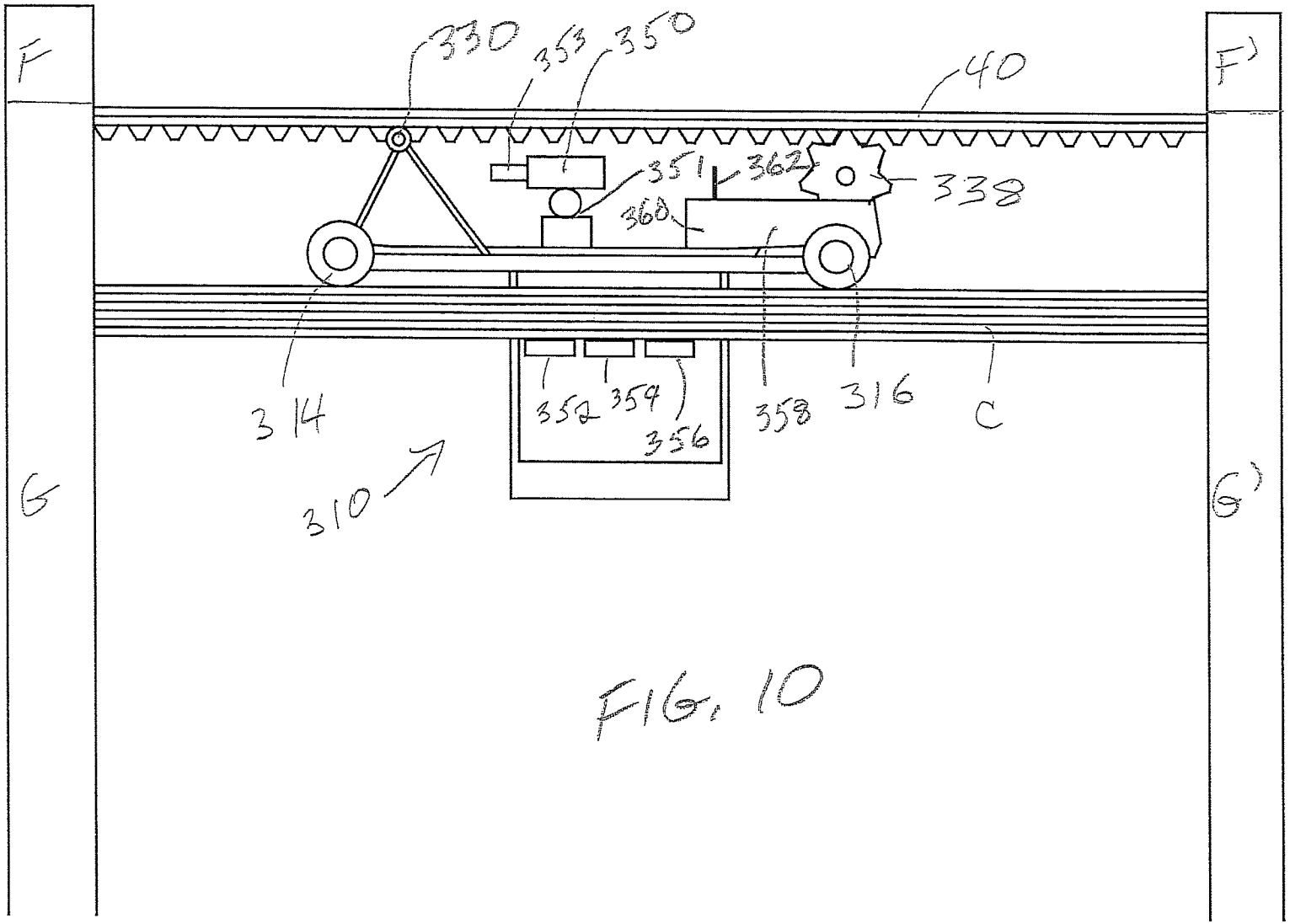
FIG. 10 is a schematic side elevation view of a fourth embodiment of a roller coaster maintenance vehicle according to the invention.

FIG. 10 illustrates a remote controlled inspection vehicle 310 according to the invention. The vehicle is designed to ride on the track system of previously incorporated U.S. Pat. No. 7,131,382. The vehicle 310 is provided with the same kinds of wheels as the vehicle 10 of FIGS. 1-5, e.g. 314, 316, 330. It is also provided with the same kind of drive pinion 338 which engages the toothed rack 340. Unlike the first embodiment, the inspection vehicle 310 is designed to be remotely operated. Thus, the vehicle is equipped with a plurality of inspection apparatus, e.g. 350, 352, 354, 356, which are coupled to electronics 358 (which includes a transceiver 360 coupled to an antenna 362). As illustrated, the inspection apparatus 350 is a video camera. The inspection apparatus 352, 354, 356 may include sensors such as an audio detector and/or an ultrasound detector. Inspection apparatus 356 may be an infrared heat source which is used in conjunction with the video camera. The video camera 350 is preferably mounted on a powered gimbal (or the like) 351 so that it can be made to pan and tilt and is preferably provided with a remotely operable zoom lens 353. From the foregoing, those skilled in the art will appreciate that a remote operator is provided with a transceiver and associated electronics (an example is described below with reference to FIG. 12) which controls the movement of the vehicle and the activation of the inspection apparatus, thereby allowing the remote operator to inspect the track system. If the remote operator discovers places where maintenance is needed, the locations are noted and a manned vehicle is sent to repair the track system.

Figure 11:
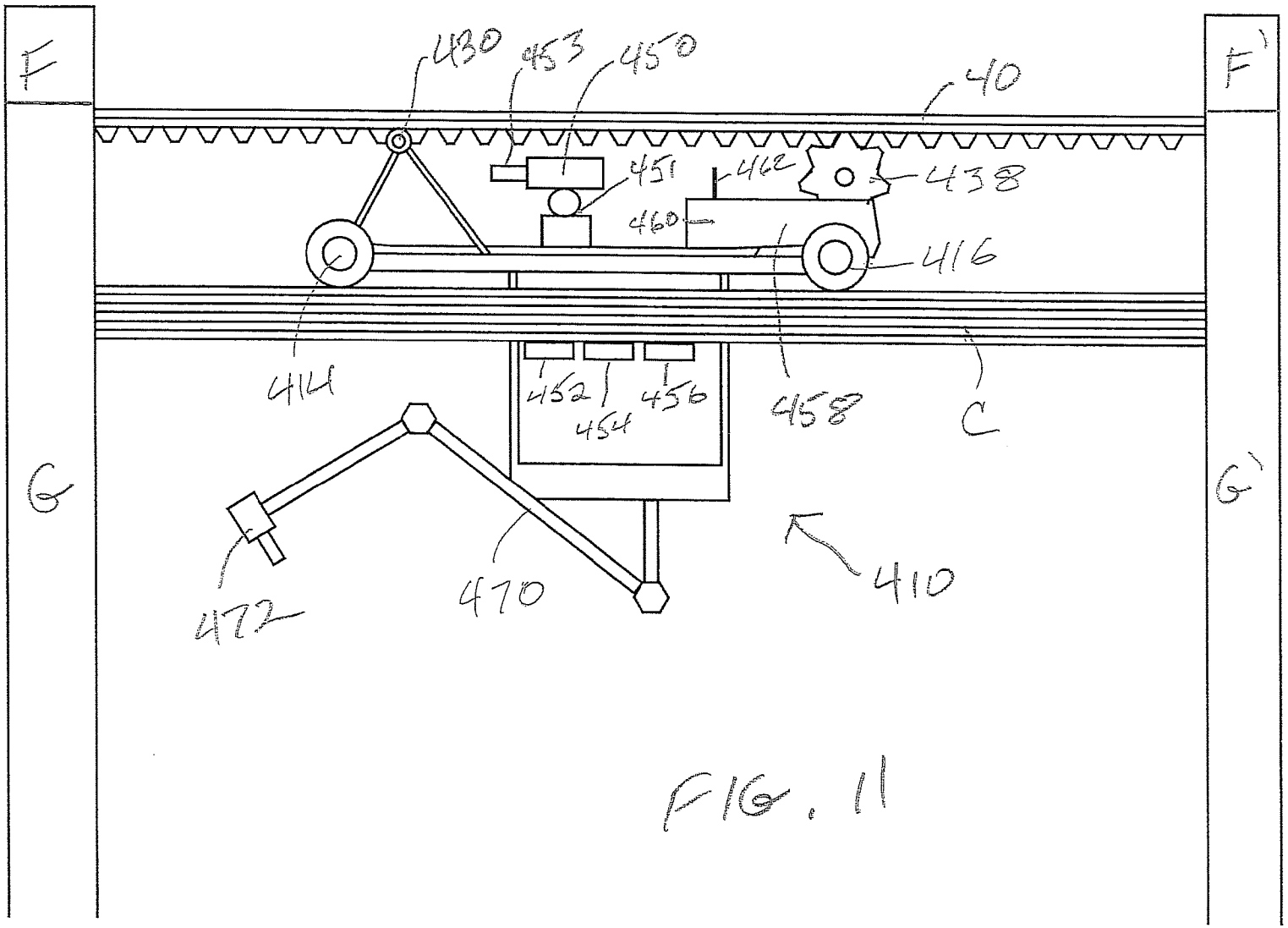
FIG. 11 is a schematic side elevation view of a fifth embodiment of a roller coaster maintenance vehicle according to the invention.

Turning now to FIG. 11, the vehicle 410 is substantially the same as the vehicle 310 described above with similar reference numerals, increased by one hundred, referring to similar parts. The only difference between vehicle 310 and vehicle 410 is that the latter is provided with a remotely controllable robot arm 470 with a remotely operable power tool 472 coupled to its free end. The tool 472 may be an electrically or pneumatically powered bolt tightener, a nail gun or a grease gun. From the foregoing, those skilled in the art will appreciate that a remote operator is provided with a transceiver and associated electronics (an example is described below with reference to FIG. 12) which controls the movement of the vehicle and the activation of the sensors, thereby allowing the remote operator to inspect the track system. If the remote operator discovers places where maintenance is needed, the remotely operable robot arm 470 is activated. The arm is operated so that the tool 472 is located at the location where maintenance is needed and the tool is operated to perform the maintenance.

From the foregoing, those skilled in the art will appreciate that the vehicles 310 and 410 could be modified to be operable on other track systems such as the track system T1 illustrated in conjunction with the vehicle 110 or the track system T2 illustrated in conjunction with the vehicle 210.

Figure 12:
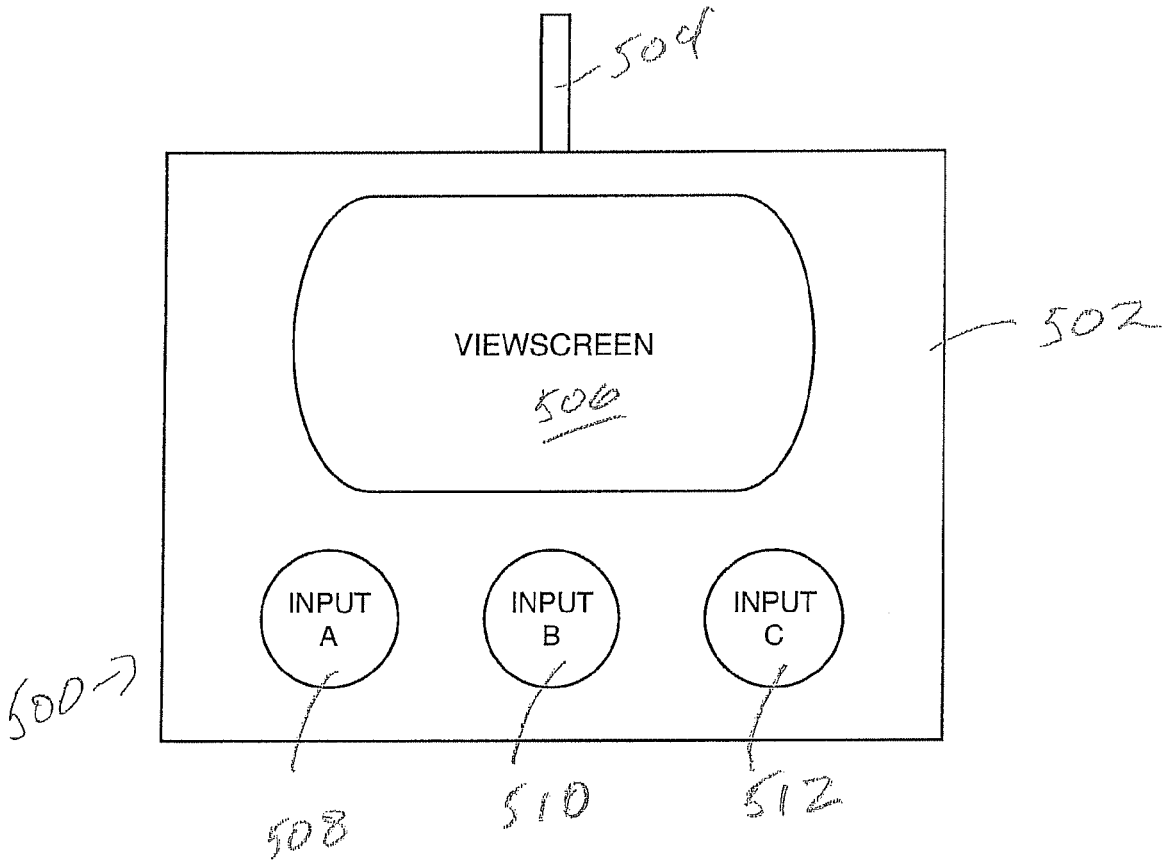
FIG. 12 is a schematic block diagram of a remote controller for the fourth and fifth embodiments.

Referring now to FIG. 12, an exemplary remote controller 500 includes a transceiver 502 coupled to an antenna 504. The transceiver is also coupled to a view screen 506 and a plurality of control inputs, e.g. 508, 510, 512. The first input 508 is used to control movement of the vehicle. The second input 510 is used to control the camera. The third input 512 is used to operate the robotic arm. It will be appreciated that other inputs and outputs may be provided to control other aspects the remotely operable inspection/maintenance vehicle.

Figure 13:
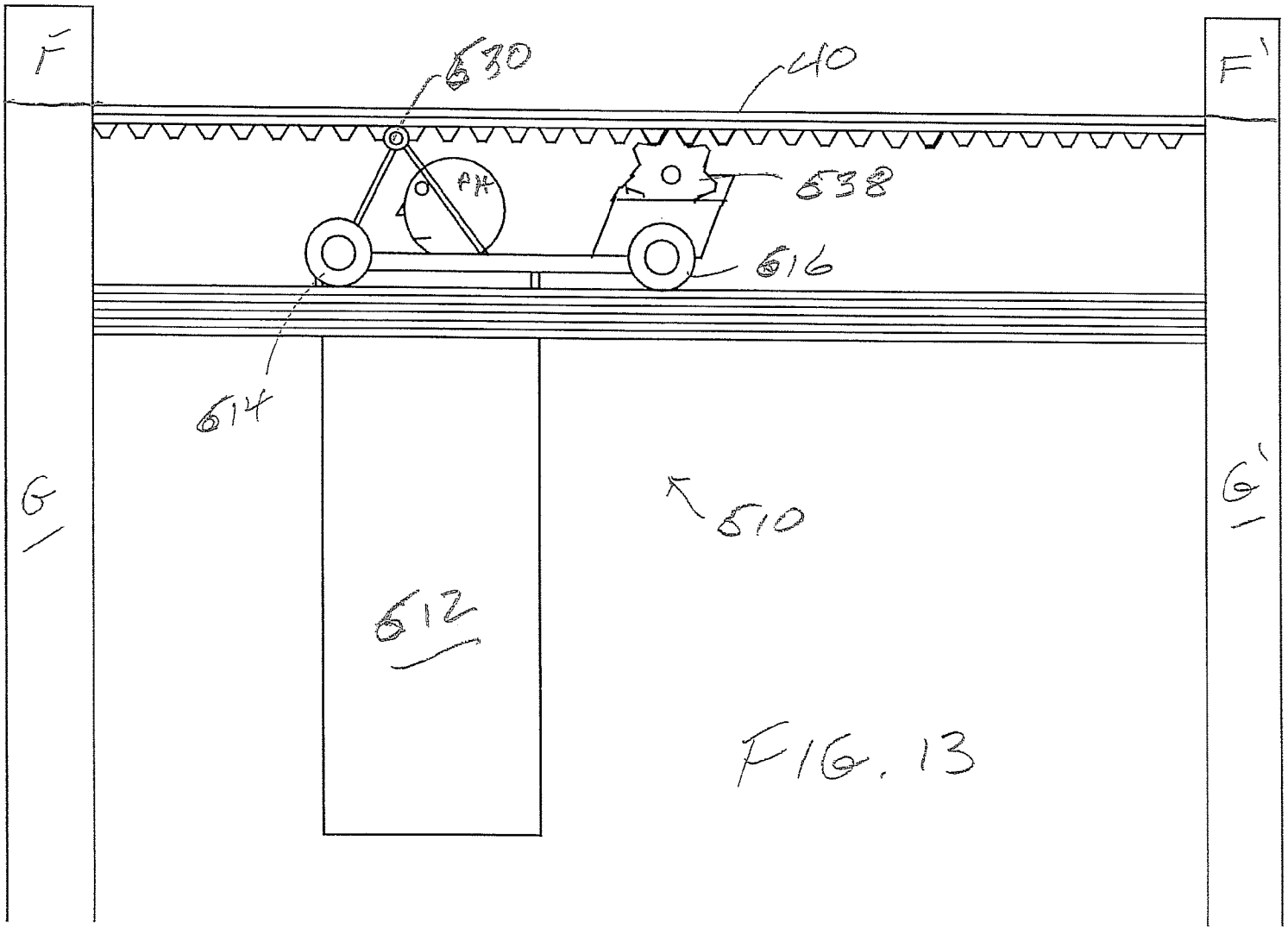
FIG. 13 is a schematic block diagram of a sixth embodiment of a roller coaster maintenance vehicle according to the invention.

FIG. 13 illustrates a sixth embodiment of a vehicle 610 according to the invention where similar reference numerals (increased by 600 relative to the embodiment of FIG. 1) refer to similar parts. Here the platform 612 includes or is in the form of a cherry picker like bucket so that the inspection/maintenance person can stand while riding the vehicle.

There have been described and illustrated herein several embodiments of a roller coaster maintenance vehicle. While particular embodiments of the invention have been described, it is not intended that the invention be limited thereto, as it is intended that the invention be as broad in scope as the art will allow and that the specification be read likewise. Thus, while particular propulsion systems have been disclosed, it will be appreciated that other propulsion systems might be usable. In addition, while particular types of inspection apparatus have been disclosed, it will be understood other types of inspection apparatus might be useful. It will therefore be appreciated by those skilled in the art that yet other modifications could be made to the provided invention without deviating from its spirit and scope as claimed.

What is claimed is:

1. A roller coaster maintenance vehicle for a roller coaster having at least one track structure and a roller coaster propulsion system operatively arranged to propel roller coaster cars along said at least one track structure, said maintenance vehicle comprising:

a platform including support structure configured to support at least one person;

a set of wheels operatively mounted to said platform and arranged to engage and ride on said at least one roller coaster track structure, said set of wheels including at least two wheels with axes of rotation substantially orthogonal to each other; and a maintenance vehicle propulsion system mounted to said platform and arranged to propel said platform along said at least one track structure, said maintenance vehicle propulsion system being independent of the roller coaster propulsion system.

2. A roller coaster maintenance vehicle according to claim 1, wherein:

said maintenance vehicle propulsion system includes a motor coupled to a gear such that said gear is rotated by said motor and a cog rack coupled to the roller coaster and located such that said cog rack is engaged by said gear when said set of wheels engage said at least one track structure and said maintenance vehicle is propelled along said at least one track structure when said gear is rotated by said motor.

3. A roller coaster maintenance vehicle according to claim 1, wherein:

said maintenance vehicle propulsion system includes a motor coupled to a tire such that said tire is rotated by said motor and fin coupled to the roller coaster and located such that said fin is engaged by said tire when said set of wheels engage said at least one track structure and said maintenance vehicle is propelled along said at least one track structure when said tire is rotated by said motor.

4. A roller coaster maintenance vehicle according to claim 1, wherein:

said support structure is configured to support the at least one person in a prone or supine position.

5. A roller coaster maintenance vehicle according to claim 1, further comprising:

a controller coupled to said maintenance vehicle propulsion system and located where a person supported by said support structure can operate said controller.

6. A roller coaster maintenance vehicle according to claim 5, wherein:

said controller is configured to cause said maintenance vehicle propulsion system to propel said platform both forward and backward.

7. A roller coaster maintenance vehicle according to claim 6, wherein:

said controller is configured to select the speed of propulsion and to cause said maintenance vehicle propulsion system to stop said platform.

8. A roller coaster maintenance vehicle according to claim 1, wherein:

said support structure includes an inclined support coupled to said platform which is configured to support a person's torso at an angle greater than zero but less than ninety degrees relative to said platform.

9. A roller coaster maintenance vehicle for a roller coaster having at least one track structure and a roller coaster propulsion system operatively arranged to propel roller coaster cars along said at least one track structure, said maintenance vehicle comprising:

a platform;

a set of wheels operatively mounted to said platform and arranged to engage and ride on said at least one roller coaster track structure, said set of wheels including at least two wheels with axes of rotation substantially orthogonal to each other;

a maintenance vehicle propulsion system mounted to said platform and arranged to propel said platform along said at least one track structure, said maintenance vehicle propulsion system being independent of the roller coaster propulsion system; and a tool bin coupled to said platform.

10. A roller coaster maintenance vehicle according to claim 1, further comprising:

at least one inspection apparatus; and a transceiver coupled to said at least one inspection apparatus and to said maintenance vehicle propulsion system.

11. A roller coaster maintenance vehicle according to claim 10, wherein:

said at least one inspection apparatus includes a video camera.

12. A roller coaster maintenance vehicle according to claim 10, wherein:

said at least one inspection apparatus includes thermal imaging apparatus.

13. A roller coaster maintenance vehicle according to claim 10, wherein:

said at least one inspection apparatus is a sound sensor.

14. A roller coaster maintenance vehicle according to claim 10, further comprising:

powered repair/maintenance equipment coupled to said transceiver.

15. A roller coaster maintenance vehicle according to claim 14, wherein:

said powered repair/maintenance equipment includes a robotic arm.

16. A roller coaster maintenance vehicle according to claim 9, further comprising:

a source of compressed air mounted to said platform.

17. A roller coaster maintenance vehicle for a roller coaster having at least one track structure and a roller coaster propulsion system operatively arranged to propel roller coaster cars along said at least one track structure, said maintenance vehicle comprising:

a platform;

a set of wheels operatively mounted to said platform and arranged to engage and ride on the at least one roller coaster track structure;

a maintenance vehicle propulsion system including a motor mounted to said platform and arranged to propel said platform along said at least one track structure, said maintenance vehicle propulsion system being independent of the roller coaster propulsion system;

a support structure mounted to said platform and being configured to support at least one person; and a controller coupled to said maintenance vehicle propulsion system and located where a person supported by said support structure can operate said controller, said controller being configured to cause said maintenance vehicle propulsion system to propel said platform both forward and reverse.

18. A roller coaster maintenance vehicle according to claim 17, wherein:

said support structure includes a bucket configured to support at least one person standing.

19. A roller coaster inspection vehicle according to claim 18, further comprising:

powered repair/maintenance equipment coupled to said platform and coupled to said transceiver.

* * * * *